US011435696B2

(12) United States Patent
Peter et al.

(10) Patent No.: US 11,435,696 B2
(45) Date of Patent: Sep. 6, 2022

(54) TORQUE SMOOTHING FOR A TIMEPIECE, PARTICULARLY WITH A STRIKING MECHANISM

(71) Applicant: Blancpain SA, Le Brassus (CH)

(72) Inventors: Julien Peter, Gollion (CH); Cedric Reymond, Les Bioux (CH)

(73) Assignee: Blancpain SA, Le Brassus (CH)

( * ) Notice: Subject to any disclaimer, the term of this patent is extended or adjusted under 35 U.S.C. 154(b) by 951 days.

(21) Appl. No.: 16/205,279

(22) Filed: Nov. 30, 2018

(65) Prior Publication Data

US 2019/0187617 A1 Jun. 20, 2019

(30) Foreign Application Priority Data

Dec. 14, 2017 (EP) ..... 17207336

(51) Int. Cl.
*G04B 21/02* (2006.01)
*G04B 13/00* (2006.01)
(Continued)

(52) U.S. Cl.
CPC ..... *G04B 13/00* (2013.01); *G04B 9/02* (2013.01); *G04B 19/02* (2013.01); *G04B 21/02* (2013.01);
(Continued)

(58) Field of Classification Search
CPC ..... G04B 13/02; G04B 9/02; G04B 19/02; G04B 21/02; G04B 21/10; G04B 23/12; G04B 21/14
See application file for complete search history.

(56) References Cited

U.S. PATENT DOCUMENTS 3,645,090 A * 2/1972 Mochizuki ..... G04B 11/006 368/32
7,065,005 B2 * 6/2006 Rochat ..... G04B 23/021 368/72
(Continued)

FOREIGN PATENT DOCUMENTS

CH 21800 9/1901
CH 1163/72 A4 5/1974
(Continued)

OTHER PUBLICATIONS

European Search Report dated Jun. 18, 2018 in European Application 17207336.3 filed on Dec. 14, 2017 (with English Translation of Categories of Cited Documents).
(Continued)

*Primary Examiner* — Sean Kayes
(74) *Attorney, Agent, or Firm* — Oblon, McClelland, Maier & Neustadt, L.L.P.

(57) ABSTRACT

Timepiece with a movement driving an output wheel set, a passing strike or minute repeater mechanism, including a strike drive wheel set including a release ratchet with which cooperates a click for execution of a strike function, a strike uncoupling lever for moving any click away from the strike wheel set, including a first lever carrying the click and its spring, the output wheel set activating a second lever, the pivoting of which causes the first lever to pivot, the striking mechanism includes a torque smoothing jumper, which is returned by a first spring into abutment on the output wheel set, in order to use, when the second lever is not in mesh with the output wheel set, an equivalent torque to that which it uses when meshed with this output wheel set.

9 Claims, 6 Drawing Sheets

(51) Int. Cl.

| | |
|---|---|
| ***G04B 9/02*** | (2006.01) |
| ***G04B 19/02*** | (2006.01) |
| ***G04B 21/10*** | (2006.01) |
| ***G04B 23/12*** | (2006.01) |
| *G04B 21/14* | (2006.01) |

(52) U.S. Cl.
CPC ..... *G04B 21/10* (2013.01); *G04B 23/12* (2013.01); *G04B 21/14* (2013.01)

(56) References Cited

U.S. PATENT DOCUMENTS

| | | | | |
|---|---|---|---|---|
| 8,724,430 | B2 * | 5/2014 | Hirano | G04B 19/253 368/80 |
| 2008/0225646 | A1 | 9/2008 | Zaugg | |
| 2009/0274010 | A1 * | 11/2009 | Vuilleumier | G04B 19/268 368/18 |
| 2010/0054091 | A1 | 3/2010 | Schiesser | |
| 2011/0032802 | A1 * | 2/2011 | Muller | G04B 19/23 368/22 |
| 2011/0216632 | A1 | 9/2011 | Lauper et al. | |
| 2012/0236691 | A1 * | 9/2012 | Hirano | G04B 19/24 368/28 |

FOREIGN PATENT DOCUMENTS

| | | | |
|---|---|---|---|
| CH | 689 337 | A5 | 2/1999 |
| CN | 101201586 | A | 6/2008 |
| CN | 102323734 | A | 1/2012 |
| CN | 102467070 | A | 5/2012 |
| EP | 1 760 545 | A1 | 3/2007 |
| EP | 1 925 995 | A1 | 5/2008 |
| EP | 2 363 764 | A1 | 9/2011 |

OTHER PUBLICATIONS

Combined Chinese Office Action and Search Report dated Jun. 22, 2020 in Patent Application No. 201811525416.X (with English translation and English translation of Categories of Cited Documents), 16 pages.

* cited by examiner

TORQUE SMOOTHING FOR A TIMEPIECE, PARTICULARLY WITH A STRIKING MECHANISM

CROSS-REFERENCE TO RELATED APPLICATION

This Applications claims priority of European Patent Application No. 17207336.3 filed on Dec. 14, 2017 the entire disclosure of which is incorporated herein by reference.

FIELD OF THE INVENTION

The invention concerns a timepiece comprising at least one movement including main energy storage means for powering at least one resonator and arranged to continuously drive at least one output wheel set including at least one tooth, said timepiece further comprising at least one display mechanism arranged to be controlled by a said movement or by user action, said display mechanism being supplied with energy at least by said main energy storage means via said output wheel set, and said display mechanism including elastic return means gradually wound by the action of said output wheel set and arranged to change the display at instants controlled by a said movement or by user action, by the unwinding of said elastic return means, the winding and unwinding cycle of said elastic return means corresponding to a variation in the torque used by said display mechanism at said output wheel set, which includes at least one tooth arranged to lift an intermediate release lever actuated by the movement, comprised in said display mechanism.

The invention concerns the field of timepieces, and more particularly watches, comprising a striking mechanism, or tune playing mechanism, like music boxes.

BACKGROUND OF THE INVENTION

In a timepiece striking mechanism, torque consumption is irregular. A significant amount of torque is used on each quarter hour, but a dip in consumption occurs until the following strike is prepared. This results in jerks in the going train, and also a variation of amplitude of the resonator of the timepiece movement.

Swiss Patent Application No CH21800A in the name of MATHEY-TISSOT discloses a minute repeater mechanism, with a rack with fourteen teeth actuating the trip intended to strike the minutes, directly attached to the fusée arbor and carrying a heel intended to drive the quarter rack via a pinion that can rotate freely on the fusée arbor. This mechanism is a specific drive and minute striking mechanism, which conventionally includes a surprise piece jumper, also called a quarter jumper in the literature, whose function is described in the work by François LECOULTRE, "*Les montres compliquées*" (A guide to complicated watches), Editions Horlogères, Bienne (Switzerland), 1985, ISBN 2-88175-000-1, FIGS. 36 & 37 page 169, and which consists in pushing out the surprise piece at zero minutes, since the first step of the minute snail is always too short to provide proper support (see FIGS. 36 & 37 page 169) The function of this surprise jumper is not to smooth or regulate a torque, since, on the contrary, it produces parasitic torque in the movement, or even wear of the racks, which has formerly led to the invention of the isolator as described at pages 177-179 & FIG. 39 of the same work. The purpose of this isolator is to remove the surprise piece jumper from the path of the surprise piece, and in the end to have no further contact with the snails and surprise piece at the centre of the movement (and therefore no further parasitic torque), and it is only actuated during the striking function when it drops to push out the surprise piece to ensure proper execution of the striking function.

European Patent Application No EP1760545A1 in the name of MONTRES JOURNE discloses a timepiece provided with a striking mechanism, comprising a common barrel for the going train and for the strike train, and a pivoting cam desmodromically connected to the arbor and drum of the common barrel, in an angular relationship chosen such that the total angle of displacement, corresponding to the total angle of winding of the striking mainspring does not exceed 360 degrees, so that its angular position is characteristic of the state of winding of the mainspring, striking racks, a coupling lever between the latter and the strike train, controlled by a release lever and a locking device capable of occupying two positions, one in which the coupling lever can be moved into an uncoupling position when it is released by the release lever, the other in which it is retained in the coupling position by the locking device, the latter comprising means intended to alternately move into mesh with the pivoting cam to move it from one of its two positions to the other.

European Patent Application No EP1925995A1 in the name of CHRISTOPHE CLARET discloses a striking mechanism comprising racks, an energy source for driving the racks and a train connecting the energy source to a regulator member, these racks are kinematically connected to the energy source via a differential gear arranged in the train.

SUMMARY OF THE INVENTION

The invention proposes to develop better regulation, by decreasing variations of torque consumption of the movement, without, however, having to cancel out said variations, due to increased torque consumption for the full-hour striking function.

To this end, the invention concerns a timepiece according to claim 1.

Because of its simplicity, but which is effective only because of the possibility of very precise fine adjustments offered by the invention, the latter also allows existing timepiece mechanisms to be optimised and the invention also concerns a timepiece comprising an additional mechanism, which can be added to an existing timepiece.

BRIEF DESCRIPTION OF THE DRAWINGS

Other features and advantages of the invention will appear from reading the following detailed description, with reference to the annexed drawings, in which:

In FIG. 7 a four-tooth star wheel forming a particular embodiment of the output wheel set.

In FIG. 8 a striking work drive wheel set with its ratchet mounted.

In FIG. 9 a striking work uncoupling lever, comprising a movement-actuated release lever, which carries a main striking work click and a thrust spring which rests on the latter.

In FIG. 10 the smoothing jumper specific to the invention.

In FIG. 11 an intermediate movement-actuated release lever which engages directly with the output wheel set.

Figure 12:
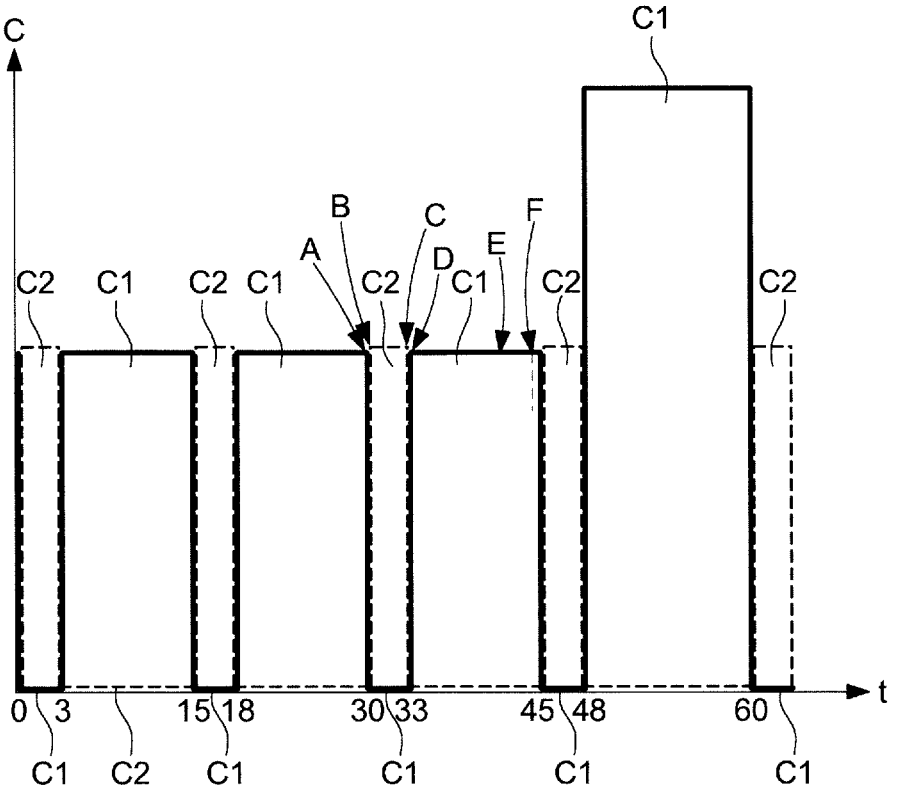
FIG. 12 is a diagram representing torque consumption on the ordinate as a function of time on the abscissa; two torque curves substantially intersect.

on the one hand a first, dotted line curve, with a periodic, substantially rectangular cycle, with equal, non-zero torque values, during 3-minute time slots at the quarter-hour changes, and which correspond to the additional resistant torque created by the torque smoothing jumper, and on the other hand, a second, continuous line curve, which corresponds to the torque consumption of the striking mechanism without implementation of the invention;

and this FIG. 12 includes the references A, B, C, D, E, F, corresponding to the respective instants of FIGS. 1 to 6.

Figure 13:
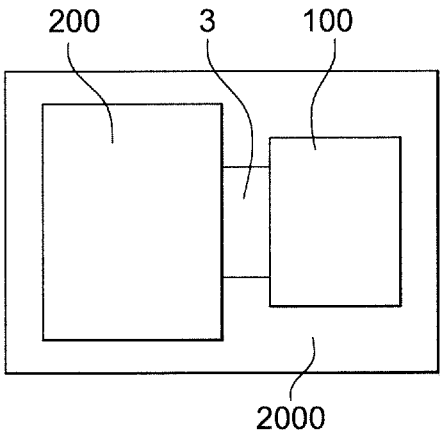

FIG. 13 is a block diagram representing a timepiece comprising a movement with its output wheel set cooperating with a striking mechanism in which is incorporated the torque smoothing jumper according to the invention.

Figure 14:
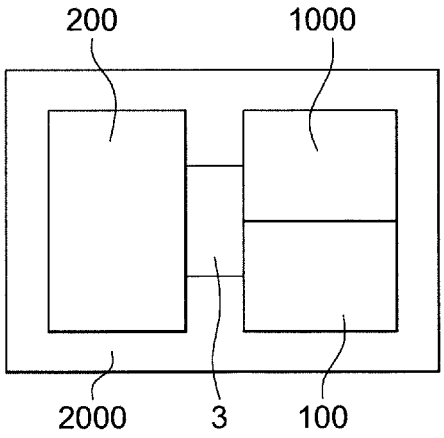

FIG. 14 is another block diagram representing a timepiece including a movement with its output wheel set cooperating with a striking mechanism, and with an additional mechanism which includes the torque smoothing jumper according to the invention.

Figure 15:
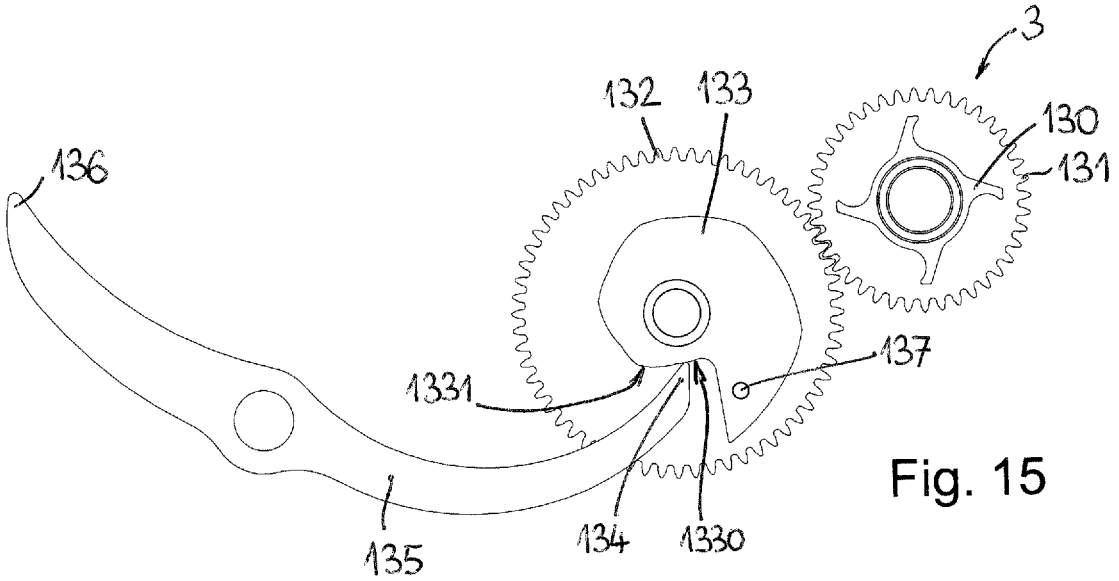
Figure 16:
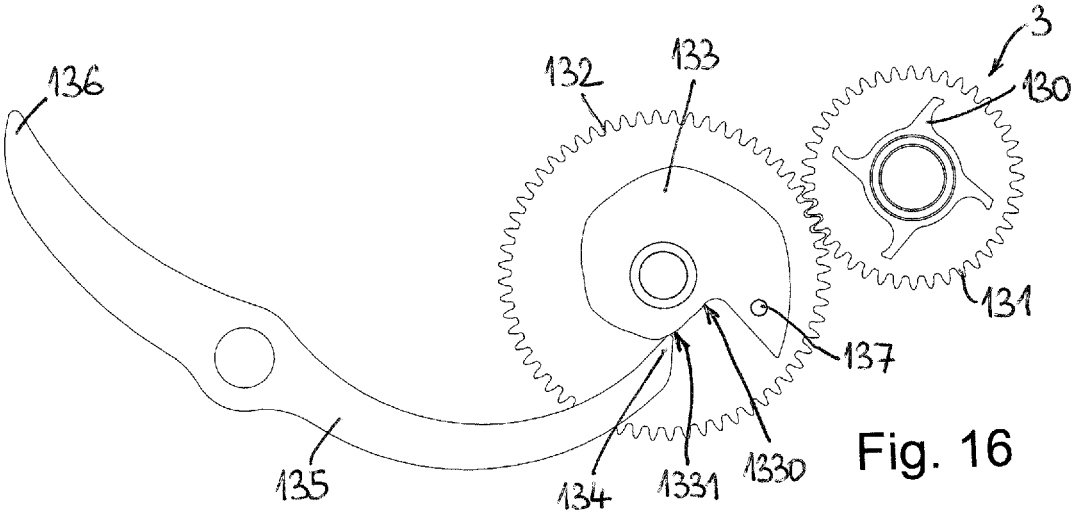

FIGS. 15 and 16 illustrate a detail of a variant including, between the output wheel set and the intermediate movement-actuated release lever comprised in the mechanism, an intermediate wheel synchronous with the output wheel set and carrying a cam which engages with a support lever, returned onto the cam by a spring (not represented in the drawing):

In FIG. 15 the lever is bearing along a radius concentric with the cam axis, the torque consumption is negligible.

In FIG. 16 the lever is bearing on a rising radius of the cam, the torque consumption corresponds to the driving of the intermediate, movement-actuated release lever.

DETAILED DESCRIPTION OF PREFERRED EMBODIMENTS

The invention concerns a timepiece 2000, particularly a watch, including at least one movement 200. This movement 200 includes main energy storage means, such as a barrel or suchlike, for powering at least one resonator. The invention concerns both mechanical watches and electromechanical watches.

This timepiece 2000 may also be a music box or include a music box.

Movement 200 is arranged to continuously drive at least one output wheel set 3 comprising at least one tooth.

This timepiece 2000 includes at least one display mechanism, which is arranged to be controlled by such a movement 200 or by user action. This display mechanism is supplied with energy by at least the main energy storage means, and/or by secondary energy storage means 220, via output wheel set 3.

This display mechanism includes elastic return means gradually wound by means of output wheel set 3 and which are arranged to change the display at instants controlled by a movement 200 or by user action, by unwinding the elastic return means. The winding and unwinding cycle of the elastic return means corresponds to a variation of the torque consumption of the display mechanism at output wheel set 3. This output wheel set 3 includes at least one tooth which is arranged to lift an intermediate, movement-actuated release lever 70 comprised in said display mechanism.

According to the invention, the display mechanism includes a torque smoothing jumper 900, which is arranged for discontinuous abutting engagement with output wheel set 3, either directly, or via an intermediate train. A first spring 902 tends to return torque smoothing jumper 900 into abutment on output wheel set 3, to consume, when intermediate, movement-actuated release lever 70 is not meshed with output wheel set 3, a torque equivalent to that used by intermediate, movement-actuated release lever 70 when it is in mesh with output wheel set 3, so as to avoid jerks in the going train of movement 200, and to prevent any amplitude variation of the resonator.

More particularly, and as illustrated by the Figures, the display mechanism is a striking mechanism 100. Output wheel set 3 includes at least one tooth, which is arranged to cooperate with control members of this striking mechanism.

Timepiece 2000 thus includes at least one striking mechanism 100 for executing a passing strike and/or minute repeater function when striking mechanism 100 includes a minute repeater. Striking mechanism 100 is arranged to be controlled by a movement 200 or by user action. Striking mechanism 100 is supplied with energy in a conventional manner by the main energy storage means and/or by secondary energy storage means 220 such as a striking barrel or similar.

This striking mechanism 100 is not detailed here. The work by François LECOULTRE entitled '*Les montres compliquées*' (A Guide to Complicated Watches) 1985, ISBN 2-88175-000-1, explains, in detail, the basic mechanisms forming striking mechanisms, at pages 97 to 205, in different chapters:

repeating watches,
old repeating watches,
modern quarter-repeater,
simplified repeater,
half-quarter repeater,
Breguet half-quarter repeater,
five minute-repeater,
minute-repeaters
clock watches Unless necessary, these basic mechanisms will not be discussed here in detail, since striking mechanism specialists will know how to find the composition of such mechanisms in this universal reference work, in particular in the aforementioned last two chapters.

The invention is illustrated in a particular, non-limiting variant with an output wheel set 3 having four arms, which corresponds to engagement every 15 minutes; naturally, in other variants that are not illustrated, this output wheel set 3 could include six arms for a repeater function every 10 minutes, or two arms for a repeater function every 30 minutes, or otherwise.

This striking mechanism 100 also includes at least one strike drive wheel set 2, as explained in particular in the chapter on 'Clock Watches' in '*Les montres compliquées*' and visible, in particular, in FIG. 40 of this book. This strike drive wheel set 2 conventionally includes a release ratchet 22 and a rack pinion.

Release ratchet 22 is arranged to cooperate with a main click 85 to execute a passing strike function, or with a minute repeater click (not illustrated in the Figures) when striking mechanism 100 includes a minute repeater.

More particularly, striking mechanism 100 includes a strike uncoupling lever 55, which is arranged to move main click 85, and said minute repeater click when said striking mechanism 100 includes a minute repeater, away from strike wheel set 2.

This strike uncoupling lever 55 includes a movement-actuated release lever 50, which carries main strike click 85 and a thrust spring 52 which rests on main strike click 85.

Output wheel set 3 includes at least one tooth arranged to lift an intermediate, movement-actuated release lever 70, comprised in striking mechanism 100, and the pivoting of which causes movement-actuated release lever 50 to pivot.

According to the invention, striking mechanism 100 includes a torque smoothing jumper 900, arranged to cooperate with output wheel set 3, either directly as illustrated in the Figures, or via an intermediate train. A first spring 902 tends to return this torque smoothing jumper 900, or the last wheel set of its intermediate train where appropriate, into abutment on output wheel set 3, to consume, when intermediate, movement-actuated release lever 70 is not in mesh with output wheel set 3, a torque equivalent to that consumed by intermediate, movement-actuated release lever 70 when it is in mesh with output wheel set 3, so as to avoid jerks in the going train of movement 200 and to prevent any amplitude variation of the resonator.

The following description only sets out the preferred case of direct connection between torque smoothing jumper 900 and output wheel set 3, those skilled in the art will have no difficulty in inserting intermediate wheel sets, especially if required by space constraints. However, the last wheel set arranged to cooperate directly with the output wheel set must then have the specific features set out below.

More particularly, striking mechanism 100 includes an eccentric member 901 resting on an arm 903 of torque smoothing jumper 900 to adjust the position of torque smoothing jumper 900, so that the torque consumption of torque smoothing jumper 900 and that of intermediate, movement-actuated release lever 70 overlap as little as possible.

More particularly, torque smoothing jumper 900 includes a polygonal head, having a main bearing surface 906 whose position can be adjusted by said eccentric member 901, separated by an edge 905 of a second bearing surface 904, which is arranged to be set in position at the factory by material removal, once movement 200 and striking mechanism 100 have been placed in timepiece 2000 and before the latter is placed in service, and in order to avoid the premature release of torque smoothing jumper 900 and thus to prevent any knocking in the resonator, and to avoid the delayed release of torque smoothing jumper 900 and thus to prevent any loss of amplitude of the resonator.

Advantageously, intermediate, movement-actuated release lever 70 includes an elastic beak 72 arranged to cooperate with a tooth of output wheel set 3. This beak 72 may, depending on the stress applied thereto, be at a distance from arm 75 of intermediate, movement-actuated release lever 70, or resting on said arm 75.

More particularly, movement-actuated release lever 70 is subject to the return torque of a second spring 501 resting on a pin 502 comprised therein.

The Figures illustrate a particular non-limiting embodiment of output wheel set 3, in the non-limiting form of a star wheel 130 releasing the strike function by the movement comprising four teeth, in order to lift, at each quarter hour, the intermediate movement-actuated release lever 70.

FIGS. 15 and 16 illustrate a detail of a variant including an intermediate wheel 132 synchronous with output wheel set 3, via a first wheel 131 comprised in the latter, and carrying a cam 133 with which one end 134 of a support lever 135 cooperates, the other end 136 of which is subject to the action of a spring (not represented) to press support lever 135 onto cam 133. The end 134 of lever 35 moves over the periphery of the cam, which is indexed on its wheel 132 by a pin 137, for synchronization between support lever 135 on cam 133 and output wheel set 3 with intermediate movement-actuated release lever 70. When output wheel set 3 is in contact with intermediate movement-actuated release lever 70, support lever 135 is along a concentric radius of cam 133, the torque consumption of the lever is then negligible; when output wheel set 3 is no longer in contact with intermediate movement-actuated release lever 70, support lever 135 is along a rising radius of cam 133, in order to use the same torque as during the driving of intermediate, movement-actuated release lever 70.

In FIG. 15, end 134 of lever 135 is resting along a radius 1330 concentric with the axis of cam 133, torque consumption is negligible. In FIG. 16, end 134 of lever 135 is resting along a rising radius 1331 of the cam and the torque consumption corresponds to the driving of the intermediate, movement-actuated release lever 70.

In a particular embodiment, cam 133 includes an alternation of concentric radii 1330 and rising radii 1331, and is of the snail type, with an abrupt jump between its largest radius and its smallest radius, as illustrated by FIGS. 15 and 16.

More particularly, intermediate wheel 132 and first wheel 131 are chosen so that each passage from one tooth to another on movement-actuated strike release star wheel 130 corresponds to a change of concentric radius 1330.

This variant may also be arranged in other ways, and especially:

the pressure on the cam can be achieved by a roller on the lever;

the shape of the cam may vary, and in particular using the possibility of restoring torque on output wheel set 3, with a descending slope instead of an ascending slope.

It is clear that the invention can be extrapolated to control various types of torque exchange, torque take-up, or torque restoration, at selected instants. This functionality is particularly advantageous for many timepiece mechanisms, especially those of the type that periodically have a high torque consumption and then nothing, over quite a short time period, of around one hour or less.

Illustrated here in the particularly advantageous case of a grande sonnerie, the mechanism according to the invention can also be used, in a non-limiting manner, in the following mechanisms, where the timepiece designer has to manage large deviations in torque, which usually leads to some components being oversized and degraded energy efficiency:

retrograde seconds;
jumping seconds;
retrograde minute;
jumping minute;

retrograde hour;
jumping hour
chronograph;
countdown;
automaton;
and suchlike.

In a particular variant, a timepiece 2000 as described above, includes an additional mechanism 1000, which includes a torque smoothing jumper 900, which is arranged to pivot on a plate or a bridge of such a timepiece 2000 or of such a display mechanism or of such a movement 200. Additional mechanism 1000 includes a first spring 902, fixed to the plate or to the bridge, and which tends to return torque smoothing jumper 900 into discontinuous abutment on output wheel set 3, either directly, or via an intermediate gear, so as to use as much torque from movement 200 as the display mechanism uses when it uses torque, during the phases where the display mechanism does not use torque from movement 200.

Additional mechanism 1000 advantageously includes an eccentric member 901, which is arranged to be fixed on the plate or on the bridge, and to rest on an arm 903 of torque smoothing jumper 900 to adjust the position of torque smoothing jumper 900, so that the torque used by torque smoothing jumper 900 and that used by the display mechanism overlap as little as possible.

More particularly, this additional mechanism 1000 is provided for a timepiece 2000, and especially but not limited to a timepiece 2000, particularly a watch, having at least one display mechanism which is a striking mechanism 100 for executing a passing strike and/or minute repeater function, and a movement 200 comprising main energy storage means for powering at least one resonator and arranged to continuously drive at least one output wheel set 3 comprising at least one tooth, and arranged to start the passing strike functions.

According to the invention, this additional mechanism 1000 includes a torque smoothing jumper 900, arranged to pivot on a plate or on a bridge of such a timepiece 2000 or of a striking mechanism 100 or of a movement 200. It includes a first spring 902, fixed to the plate or to the bridge, and tending to return the torque smoothing jumper 900 into abutment on output wheel set 3, either directly, or via an intermediate train, so as to use as much torque from movement 200 as striking mechanism 100 uses when it uses torque, during the phases where striking mechanism 100 does not use torque from movement 200.

The invention also concerns such a timepiece 2000 including at least one such additional mechanism 1000.

The kinematics are set out in FIGS. 1 to 6, in relation to instants A to F close to the half hour and three quarter-hours in the graph of FIG. 12, which illustrates an example implementation of the invention in a grande sonnerie wristwatch, with torque on the ordinate and time in minutes on the abscissa.

Figure 1:
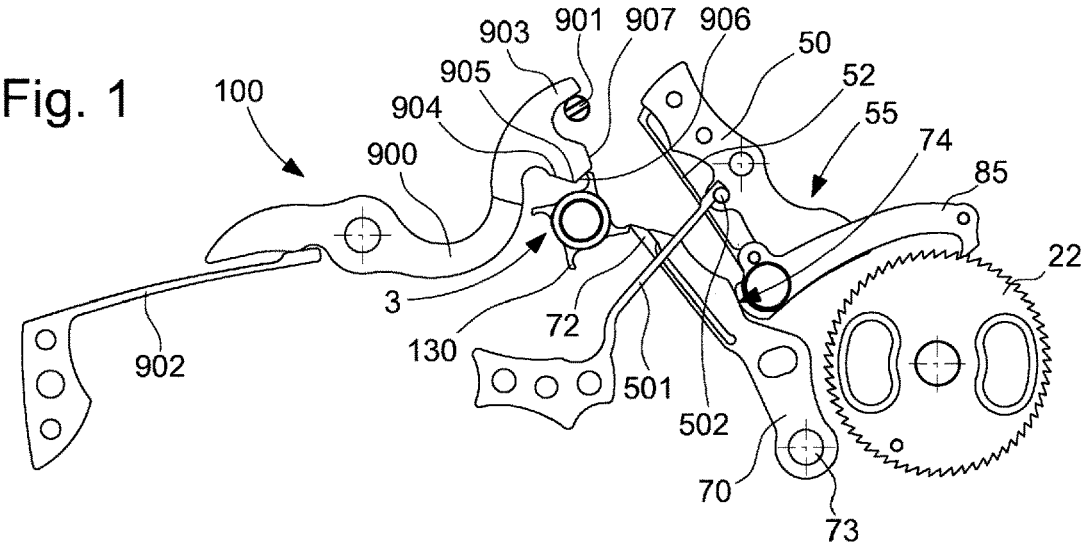
FIGS. 1 to 6 represent schematic plan views, in six successive positions, of a detail of a particular embodiment of the invention, wherein the display mechanism is a striking mechanism incorporated in a timepiece, and which includes: around an output wheel set driven by a timepiece movement, here formed in a non-limiting manner by a four-tooth star wheel, on the one hand, components specific to the striking mechanism: a release ratchet cooperating with a main click carried, together with its spring, by a release lever actuated by the movement, and an intermediate release lever actuated by the movement, periodically lifted by a tooth of the output wheel set, and whose pivoting causes the movement-actuated release lever to pivot, and on the other hand, a torque smoothing jumper, which is returned by a first spring into abutment on the output wheel set.

FIG. 1, at instant A, shows arm 903 of jumper 900 at rest on eccentric member 901. A first tooth of output wheel set 3 is resting on the main bearing surface 906, on the opposite side to edge 905, and its subsequent travel along bearing surface 906, against first spring 902, will translate into torque consumption by torque smoothing jumper 900. A second tooth of output wheel set 3 is resting tip-to-tip on beak 72, which it is preparing to leave. Click 85 is in the end position, the furthest back with respect to ratchet 22.

Figure 2:
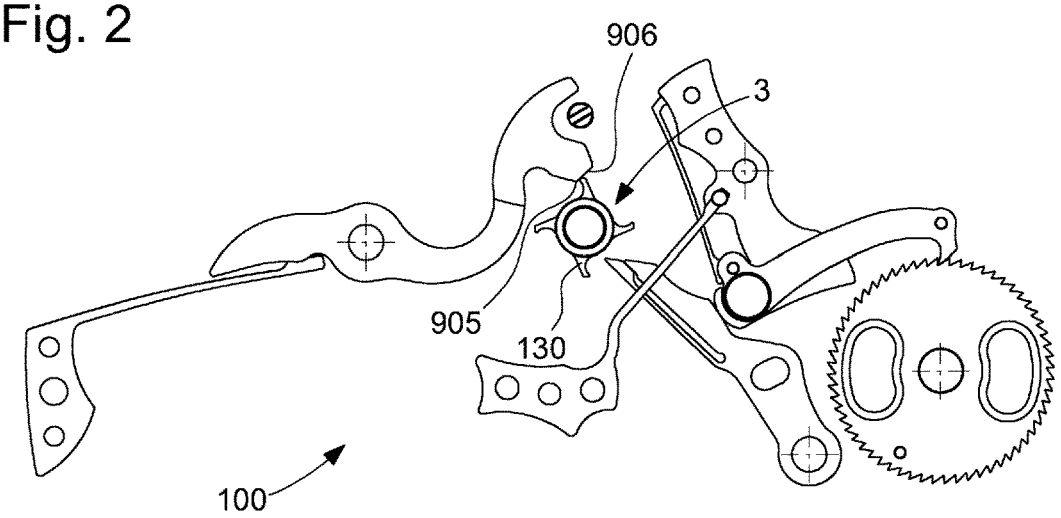

FIG. 2, at instant B immediately following instant A, around one second afterwards, shows output wheel set 3 pushing jumper 900 in the anticlockwise direction, still on main bearing surface 906, and moving closer to edge 905, and removing its arm 903 from eccentric member 901. The torque smoothing energy consumption is performed during this phase. Intermediate, movement-actuated release lever 70, which is no longer retained by output wheel set 3, pivots in the anticlockwise direction, its travel being limited by a pin (not represented) which cooperates with the oblong hole contained therein. Click 85 is still immobile, but the pivoting of intermediate, movement-actuated release lever 70 will allow movement-actuated release lever 50 to pivot, and thus allow the click to move towards the left of the Figure.

Figure 3:
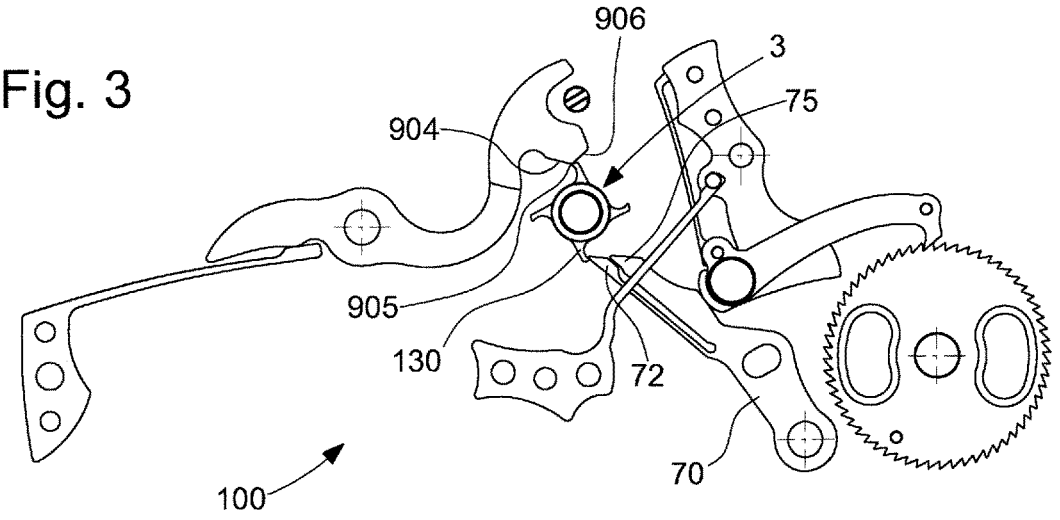

FIG. 3, at instant C a few minutes after instant B, shows the instant at which torque consumption by torque smoothing jumper 900 ends, in order to return to torque consumption by the striking mechanism. One tooth of output wheel set 3 is on edge 905, tip-on-tip, which corresponds to the highest point of jumper 900, another tooth of output wheel set 3 comes into contact with beak 72 of intermediate, movement-actuated release lever 70, without yet causing it to bend, which will allow second spring 501 to be wound, pushing movement-actuated release lever 50 and then first spring 902 via jumper 900.

Figure 4:
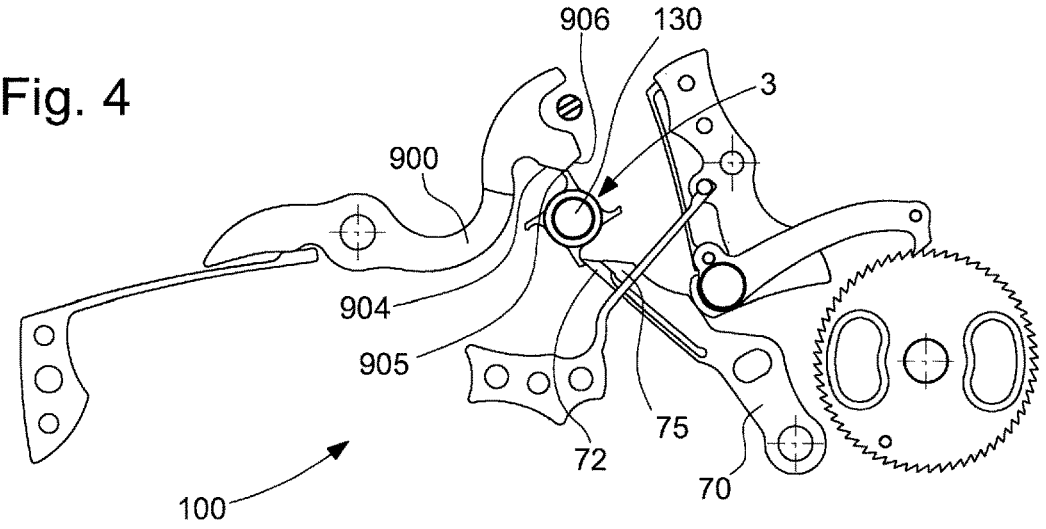

FIG. 4, at instant D immediately following instant C, around one second afterwards, shows the tooth of output wheel set 3 crossing edge 905, and the other tooth of output wheel set 3 now pushes beak 72 of intermediate movement-actuated release lever 70 resting on its arm 75, thus taking up play.

Figure 5:
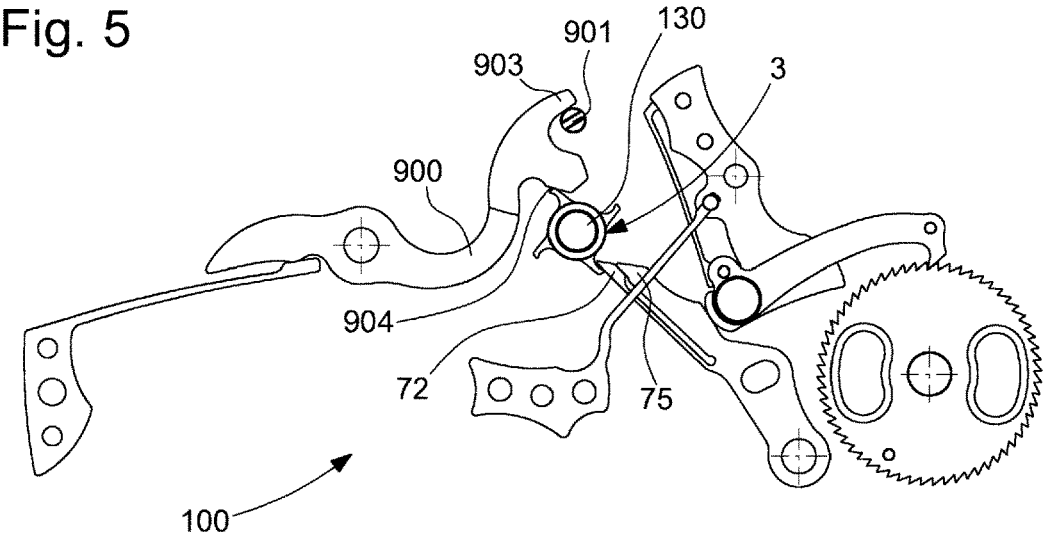

FIG. 5, at instant E a few minutes after instant D, shows the clockwise travel of intermediate, movement-actuated release lever 70, pushed by a tooth of output wheel set 3, corresponding to the winding of the strike release lever. The opposite tooth of output wheel set 3 is along second bearing surface 904. Jumper 900 falls slowly back in the clockwise direction, accompanying the rotation of output wheel set 3, and thus gives torque to the strike release mechanism. Arm 903 of jumper 900 comes back into contact with eccentric member 901. Fine adjustment of the latter makes possible the precise adjustment of the position of edge 905 of torque smoothing jumper 900. Click 85 starts to recoil.

Figure 6:
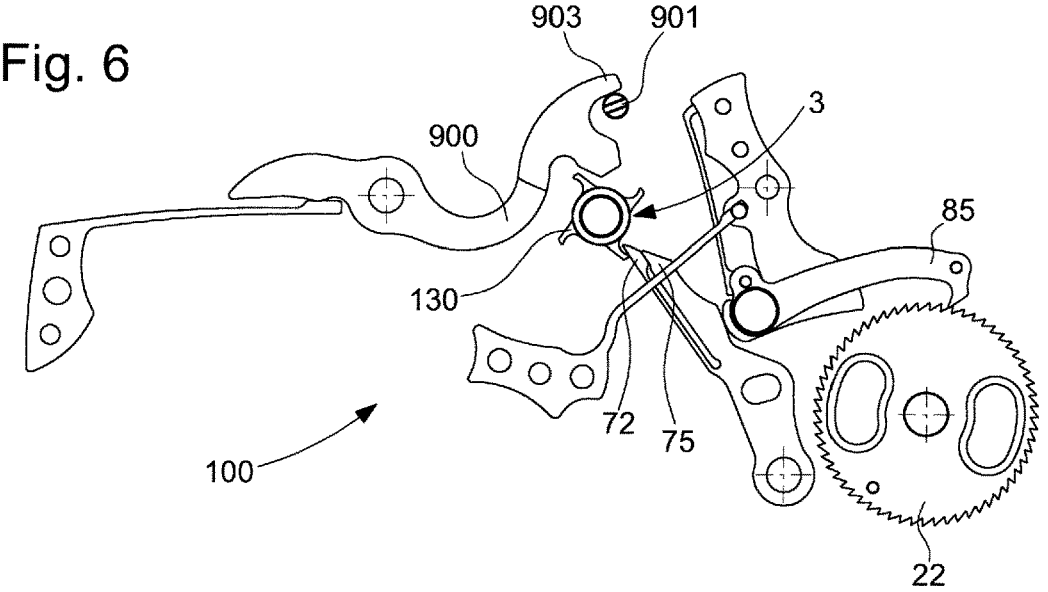
Figure 7:
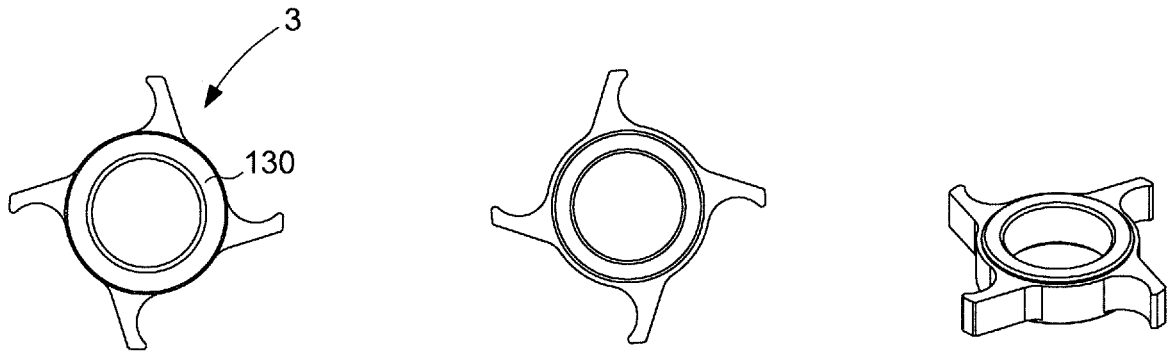
FIGS. 7 to 11 represent schematically, in each case top, bottom and perspective views, of various components specific to this mechanism.
Figure 8:
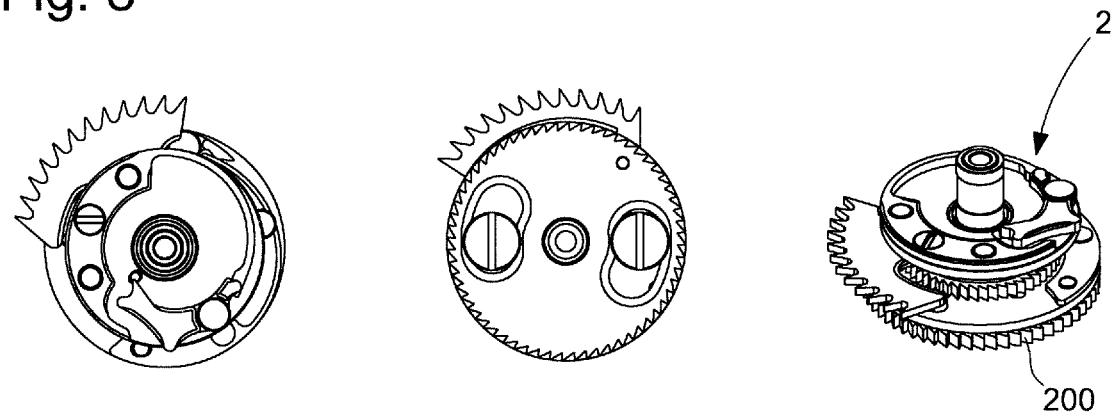
Figure 9:
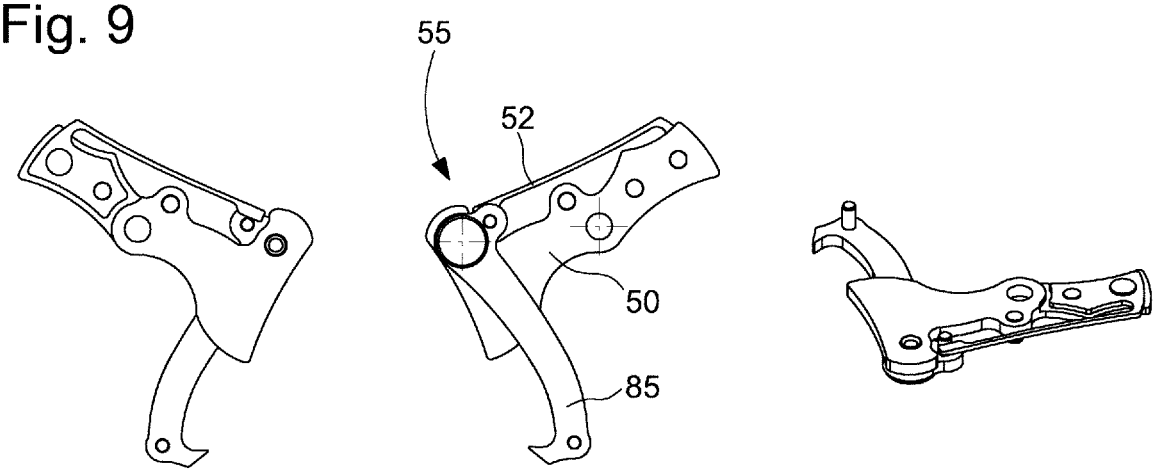
Figure 10:
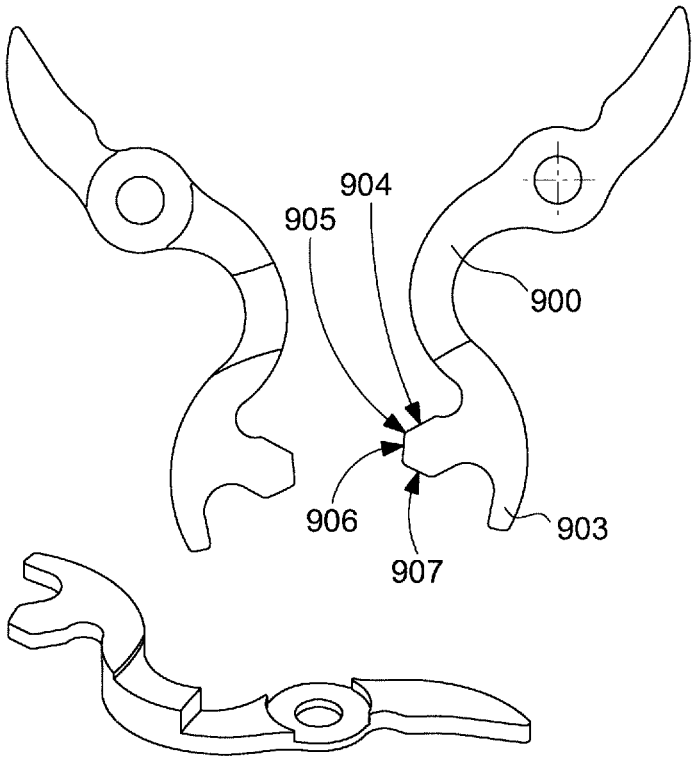
Figure 11:
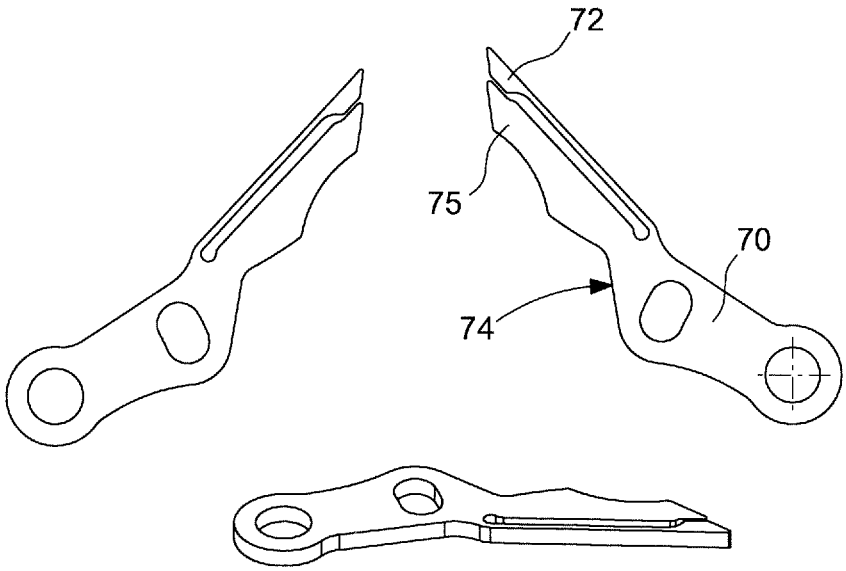

FIG. 6, at instant F a few minutes after instant E, shows output wheel set 3 with no contact with jumper 900, which is abutting on eccentric member 901, and which completes the pushing, in the clockwise direction, of beak 72 and of intermediate, movement-actuated release lever 70, whose face 74 drives movement-actuated release lever 50. The continued rotation of output wheel set 3 then returns the assembly to the position of FIG. 1.

The invention claimed is:

1. A timepiece comprising:

at least one movement including main energy storage means for powering at least one resonator and arranged to continuously drive at least one output wheel set including at least one tooth; and at least one display mechanism arranged to be controlled by a said movement or by user action, said display mechanism being supplied with energy at least by said main energy storage means and/or by secondary energy storage means via said output wheel set, and said display mechanism including elastic return means gradually wound by means of said output wheel set and arranged to change the display at instants controlled by a said movement or by user action, by unwinding said elastic return means, the winding and unwinding cycle of said elastic return means corresponding to a variation in the torque used by said display mechanism at said output wheel set, which includes at least one tooth arranged to lift an intermediate movement-actuated release lever, comprised in said display mechanism, wherein said display mechanism includes a torque smoothing jumper which is arranged for discontinuous abutting engagement with said output wheel set, either directly, or via an intermediate train, and which a first spring tends to return into abutment on said output wheel set, in order to use, when said intermediate, movement-actuated release lever is not in mesh with said output wheel set, a torque equivalent to that used by said intermediate, movement-actuated release lever when it is in mesh with said output wheel set, so as to avoid jerks in the going train of said movement and to prevent any amplitude variation of said resonator.

2. The timepiece according to claim 1, wherein said display mechanism is a striking mechanism for executing a passing strike and/or minute repeater function when said striking mechanism includes a minute repeater, said striking mechanism being arranged to be controlled by a said movement or by user action, said striking mechanism being supplied with energy by said main energy storage means and/or by said secondary energy storage means, and said striking mechanism including at least one strike drive wheel set including a release ratchet with which is arranged to cooperate a main click for the passing strike function and/or the minute repeater function when said striking mechanism includes a minute repeater, wherein said striking mechanism includes a strike uncoupling lever arranged to move away from said strike wheel set said main click and said minute repeater release click when said striking mechanism includes a minute repeater, said strike uncoupling lever including a movement-actuated release lever which carries said main strike click and a thrust spring which rests on said main strike click, in that said output wheel set includes at least one tooth arranged to lift an intermediate, movement-actuated release lever, comprised in said striking mechanism, and the pivoting of which causes movement-actuated release lever to pivot, and in that said striking mechanism includes a torque smoothing jumper which is arranged for discontinuous abutting engagement with said output wheel set, either directly, or via an intermediate train, and which a first spring tends to return into abutment on said output wheel set, in order to use, when said intermediate, movement-actuated release lever is not in mesh with said output wheel set, a torque equivalent to that used by intermediate, movement-actuated release lever when it is in mesh with said output wheel set, so as to avoid jerks in the going train of said movement and to prevent any amplitude variation of said resonator.

3. The timepiece according to claim 2, wherein said striking mechanism includes an eccentric member resting on an arm of said torque smoothing jumper to adjust the position of said torque smoothing jumper so that the torque used by said torque smoothing jumper and that used by said intermediate, movement-actuated release lever overlap as little as possible.

4. The timepiece according to claim 3, wherein said torque smoothing jumper includes a polygonal head including a main bearing surface whose position can be adjusted by said eccentric member, separated by an edge from a second bearing surface which is arranged to be set in position at the factory by material removal, once said movement and said striking mechanism have been placed in said timepiece and before the latter is placed in service, and in order to avoid the premature release of said torque smoothing jumper and thus to prevent any knocking in the resonator, and to avoid the delayed release of said torque smoothing jumper and thus to prevent any loss of amplitude of said resonator.

5. The timepiece according to claim 2, wherein said intermediate, movement-actuated release lever includes an elastic beak arranged to cooperate with a tooth of said output wheel set.

6. The timepiece according to claim 2, wherein said movement-actuated release lever is subject to the return torque of a second spring resting on a pin comprised therein.

7. The timepiece according to claim 1, wherein said output wheel set is a star wheel with four teeth, in order to lift, at each quarter hour, said intermediate, movement-actuated release lever.

8. The timepiece according to claim 1, wherein said output wheel set includes a first wheel for driving an intermediate wheel carrying a cam with which cooperates one end of a support lever, the other end of which is subject to the action of a spring arranged to press said support lever onto said cam, the profile of said cam being such that, when said output wheel set is in contact with said intermediate, movement-actuated release lever, said support lever is along a concentric radius of said cam, and, when said output wheel set is no longer in contact with said intermediate, movement-actuated release lever, said support lever is along a rising radius of said cam, in order to use the same torque as during the driving of said intermediate, movement-actuated release lever.

9. The timepiece according to claim 1 further comprising:

an additional mechanism which includes a torque smoothing jumper, arranged to pivot on a plate or a bridge of a said timepiece or of a said display mechanism or of a said movement, and includes a first spring fixed to said plate or to said bridge and tending to return said torque smoothing jumper into discontinuous abutment on said output wheel set, either directly, or via an intermediate gear, so as to use as much torque from said movement as said display mechanism uses when it uses torque, during the phases where said display mechanism does not use torque from said movement, and in that said additional mechanism includes an eccentric member arranged to be fixed on said plate or on said bridge, and to rest on an arm of said torque smoothing jumper to adjust the position of said torque smoothing jumper so that the torque used by said torque smoothing jumper and that used by said display mechanism overlap as little as possible.

* * * * *